US005215260A

United States Patent [19]

Robbins

[11] Patent Number: 5,215,260

[45] Date of Patent: Jun. 1, 1993

[54] PLUMBING SPOUT

[75] Inventor: Tom E. Robbins, San Leandro, Calif.

[73] Assignee: Kallista, Inc., San Leandro, Calif.

[21] Appl. No.: 841,149

[22] Filed: Feb. 25, 1992

[51] Int. Cl.[5] ..... B05B 1/06

[52] U.S. Cl. ..... 239/590.5; 239/597

[58] Field of Search ..... 239/589, 590.5, 597, 239/599, 553–553.5, 590.3; 137/801

[56] References Cited

U.S. PATENT DOCUMENTS

| | | | |
|---|---|---|---|
| 157,575 | 12/1874 | Brooks | 239/434.5 |
| 508,354 | 11/1893 | Stockstrom | 239/597 X |
| 637,850 | 11/1899 | Buerkle | 239/597 |
| 1,476,471 | 12/1923 | Schlesinger | 4/624 |
| 1,738,199 | 12/1929 | Peabody | 239/456 |
| 2,024,693 | 2/1934 | Klemme | 239/597 |
| 2,716,915 | 9/1955 | Biber | 239/597 X |
| 2,922,277 | 1/1960 | Bertin | 244/12.2 |
| 3,096,813 | 7/1963 | Weber | 239/597 |
| 3,216,653 | 11/1965 | Le Nabour | 239/598 X |
| 4,030,669 | 6/1977 | Mendoza | 239/599 |
| 4,339,081 | 7/1982 | Lindqvist | 239/552 |

OTHER PUBLICATIONS

One page ad for a Fornara spout, undated, admitted prior art.

*Primary Examiner*—Andres Kashnikow
*Assistant Examiner*—Lesley D. Morris
*Attorney, Agent, or Firm*—Quarles & Brady

[57] ABSTRACT

A plumbing spout is disclosed that discharges a hollow cylinder of water. In one form, the inside of the cylinder can be viewed from the top of the spout. Concentric walls are provided in a spout body to equalize the pressure of the entering water around the spout circumference. An inner wall extends below an outer wall when the fluid discharges from the spout to assist in cylinder formation. The portion of the inner wall that extends below the outer wall preferably also flares outwardly.

3 Claims, 2 Drawing Sheets

PLUMBING SPOUT

BACKGROUND OF THE INVENTION

A. Field Of The Invention

This invention relates primarily to flow spouts that discharge a continuous sheet of fluid wherein the sheet encloses upon itself and creates a cavity within the sheet. In particular, the invention relates to spouts of the foregoing type wherein fluid flowing from the spout retains its flow shape in the horizontal plane after leaving the spout.

B. Description Of The Art

For aesthetic purposes or to conserve water, it is often desired to flow water from faucets in unique configurations. Many spouts or shower heads spray water through holes or slits to create individual jets of water. The holes or slits in such spouts or shower heads can be configured so that the individual jets of water flow in a desired pattern, such as around the perimeter of a circle for instance. This is shown in U.S. Pat. No. 1,476,471.

Other faucets in the art flow water in a continuous sheet, typically using a straight and relatively long, thin slit as a flow outlet. Water has a natural tendency to pull together when it flows downward from a spout due to molecular attraction, and for this reason it is difficult to flow water in an aesthetically pleasing continuous sheet when the sheet is curved in the horizontal plane. This is especially true when the continuous sheet of water is intended to create a longitudinal tube or other geometric configuration where the sheet defines a closed perimeter in a horizontal plane. It is also known in the prior art to flow fluid such as oil in a downward manner in the form of a sheet. This is described in U.S. Pat. No. 2,716,915.

One problem is that the wall of the longitudinal cavity created by a continuous sheet of water tends to come together within a short distance after the water flows from the spout. Another problem is that the wall tends to break apart or become non-uniform as the water flows downward.

Increasing the water pressure of water flowing in a continuous sheet from a spout helps maintain the integrity of the sheet as the water flows downward, but it is nonetheless desirable to maintain sheet integrity without having to substantially increase water pressure.

SUMMARY OF THE INVENTION

In one aspect, the present invention provides an apparatus for discharging a continuous sheet of a fluid wherein the sheet defines a closed perimeter in a horizontal plane and creates a cavity within the sheet, the apparatus having a fluid inlet compartment, an outer wall, and an inner wall. The outer wall encloses upon itself. The inner wall also encloses upon itself and is constructed and arranged inside the outer wall, thus forming a fluid outlet between the inner and outer walls. The fluid outlet is in fluid communication with the fluid inlet compartment. The inner and outer walls are substantially parallel and co-extensive immediately before the fluid discharges the fluid outlet. The inner wall extends below the outer wall at the point where the fluid discharges from the apparatus.

In one embodiment, the apparatus of the present invention includes a means for equalizing the pressure of the fluid before the fluid discharges through the fluid outlet. A very unbalanced, unaesthetic flow occurs if fluid pressure is not substantially uniform before the fluid discharges. A preferred means for equalizing the pressure of the fluid before the fluid discharges through the fluid outlet is to have 1) a fluid inlet compartment for receiving and holding the fluid before it is discharged through the fluid outlet, and 2) a plate with holes for restricting the flow of the fluid from the fluid inlet compartment to the fluid outlet.

In another aspect, the portion of the inner wall that is below the outer wall may flare outward. An outward flare redirects the fluid slightly outwards as it discharges and thus helps to prevent the sheet from pulling together.

In another aspect, the outward flare on the inner wall may be concave. A concave flare can redirect the fluid outward more abruptly than a straight flare without disrupting fluid continuity.

In another preferred form, the inner and outer walls are annular. In this form, the apparatus discharges a continuous sheet of fluid wherein the sheet defines a circular perimeter in a horizontal plane. That is, the fluid is discharged in a continuous tube, or in a bell-type shape if a concave flare is used.

In another aspect, the present invention provides a water spout faucet.

The objects of the invention therefore include:

a. creating a uniform tube or bell-like sheet of water from a spout outlet to when the water comes into contact with a tub or basin into which it is being poured;

b. creating an aesthetically pleasing flow while conserving water; and c. providing an apparatus to create the foregoing sheet or flow of water with a minimum amount of component parts.

These and still other objects and advantages of the invention will be apparent from the description which follows. In the detailed description below, the preferred embodiments of the invention will be described in reference to the accompanying drawings. These embodiments do not represent the full scope of the invention. Rather, the invention may be employed in other embodiments.

DESCRIPTION OF THE PREFERRED EMBODIMENTS

Figure 1:
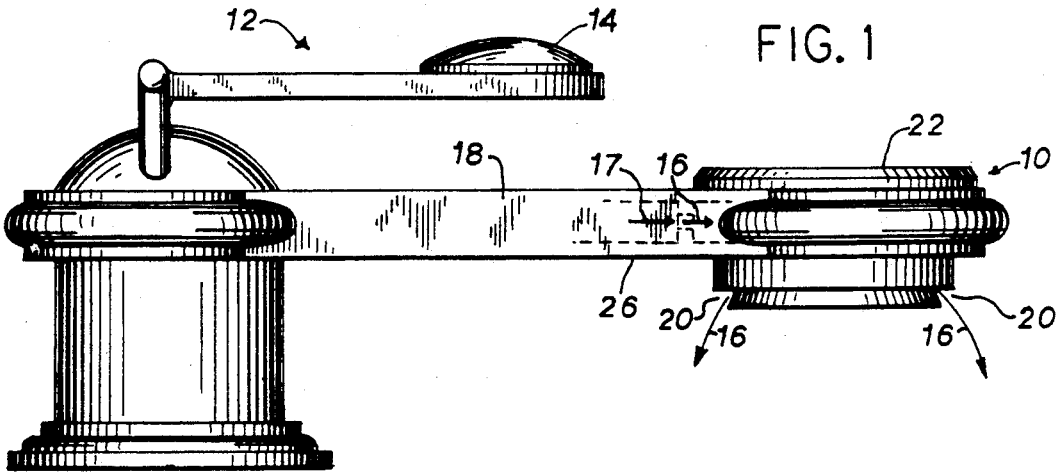
FIG. 1 is a side elevational view showing a water flow spout assembly constituting a preferred embodiment of the invention.

Referring to FIG. 1, a spout generally 10 is shown in conjunction with a water spout faucet generally 12 connected to a common hot and cold water supply. Faucet 12 is of the single handle type and has a control handle 14 which controls the flow of water through the water spout faucet 12 as indicated by arrows 16. Water flows through the neck 18 of the faucet 12 to the spout 10 and then flows out of the spout 10 through an annular spout outlet 20.

Figure 2:
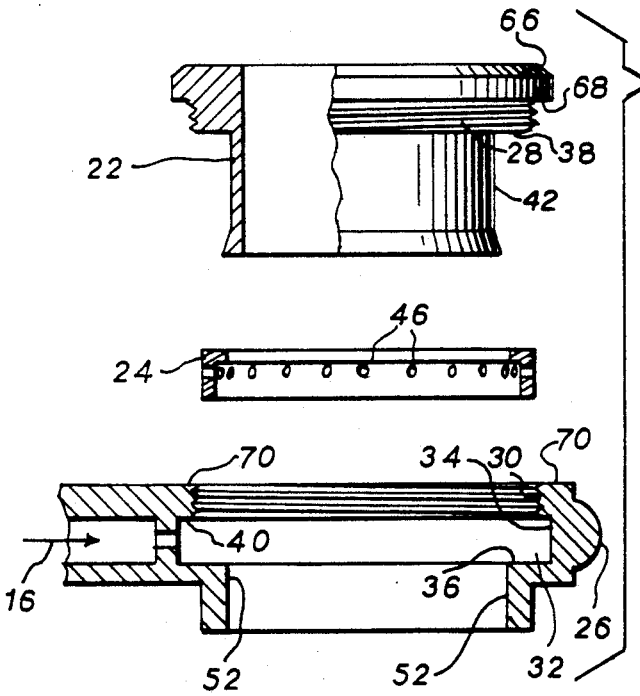
FIG. 2 is an exploded assembly view of the spout constituting a preferred embodiment of the invention as shown in FIG. 1.

Referring to FIG. 2, the spout 10 is constructed from three physically separate components: an inner annular tube 22, a diverter/restricter ring 24, and an outer annular tube 26. The inner annular tube 22 has a threaded portion 28 near the top of its outer surface. The outer annular tube 26 has a threaded portion 30 at the top of its inner surface for receiving the threaded portion 28 of the inner annular tube 22. The spout 10 is assembled by placing the diverter/restricter ring 24 in a pressure equalization chamber 32 within the outer annular tube 26 and then screwing the inner annular tube 22 into the outer annular tube 26.

Figure 4:
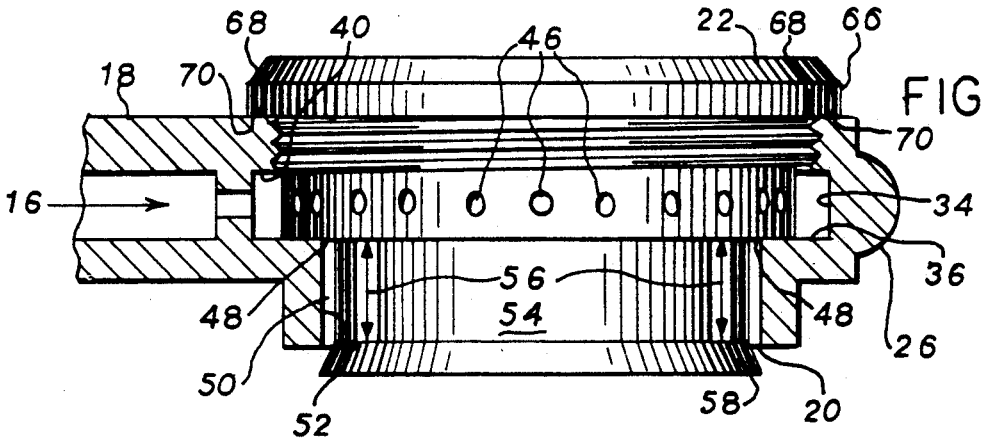
FIG. 4 is a view similar to FIG. 3 showing the diverter/restricter ring.

Referring to FIGS. 2 and 4, the inner annular tube 22 has a flange 66 above the threaded portion 28. The bottom surface 68 of the flange 66 abuts tightly to the top surface 70 of the outer annular tube 26 when the inner annular tube 22 is properly screwed into the outer tube 26.

Figure 3:
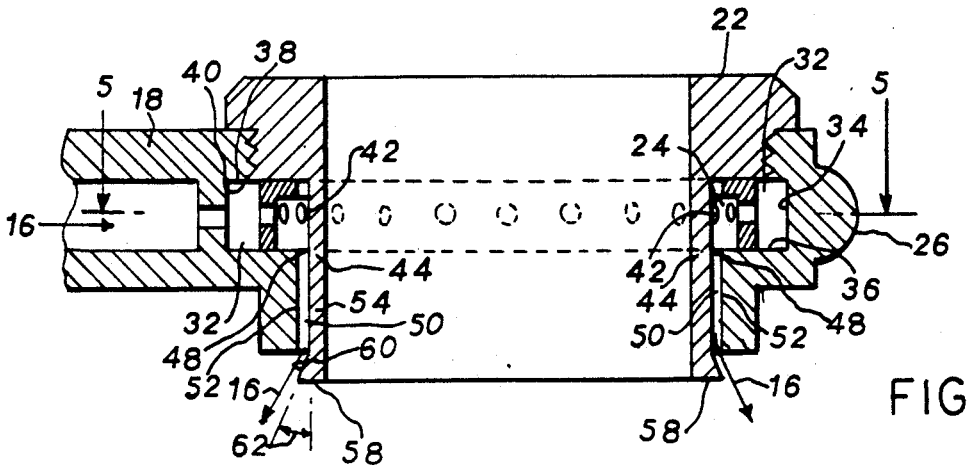
FIG. 3 is an enlarged view in vertical section of the components shown in FIG. 2.

Referring to FIG. 3, water flows from the neck 18 of the faucet 12 into the pressure equalization chamber 32. The pressure equalization chamber 32 is an annular-shaped chamber with its outer and lower surfaces being formed by walls 34 and 36 of the outer annular tube 26, its upper surface formed by a wall 40 of the outer annular tube 26 and a horizontal surface 38 underneath the threaded portion 28 of the inner annular tube 22, and its inner surface being an upper portion 42 of an outer wall 44 of the inner annular tube 22. After water flows into the pressure equalization chamber 32, water 16 flows through holes 46 in the restricter/diverter ring 24. The ring is preferably is the form of a plate with a central hole. The holes 46 in the restricter/diverter ring 24 are located near the top of the ring and are spaced equidistantly around the ring 24. Flowing the water through the holes 46 in the ring 24 tends to equalize water pressure before the water 16 flows to an annular opening 48 of an annular channel 50. This is best seen in FIG. 4. Pressure equalization allows the water to flow out of the annular outlet 20 more uniformly.

Still referring to FIG. 3, after the water flows through the holes 46 in the restricter/diverter ring 24 in the pressure equalization chamber 32, it flows through the annular channel 50. The annular channel 50 resides between an inner annular wall 52 of the lower part of the outer annular tube 26 and a lower portion 54 of the wall 44 of the inner annular tube 22. Referring to FIG. 4, the length 56 of the annular channel 50 is large enough to assure that water flowing through the annular channel has a proper flow path before exiting the spout 10 at the outlet 20. Note that the lower portion 54 of the wall 44 of the inner annular tube 22 and the wall 52 of the outer annular tube 26 are substantially parallel so that the water flowing through the annular channel 50 adapts a parallel flow path.

Figure 6:
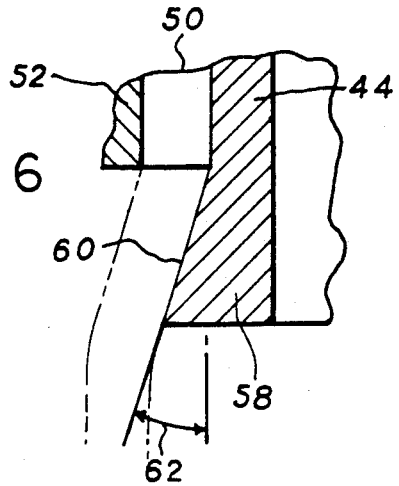
FIG. 6 is an enlarged partial view in vertical section showing one embodiment of the invention illustrated in FIGS. 3 and 4.

The inner annular tube 22 extends below the outer annular tube 26 as represented by the portion 58 of wall 44 that resides below the outer annular tube 26. A smooth walled surface 60 of the wall portion 58 flares outward at an angle 62 of about 15 to 20 degrees from the vertical wall 44. This is best seen in FIG. 6. The flared portion 58 serves to direct the flow of water slightly outward before the water falls downward in the form of a cylindrical tube. The slight outward redirection of the water helps to prevent the wall of the water tube from collapsing inwards.

Figure 5:
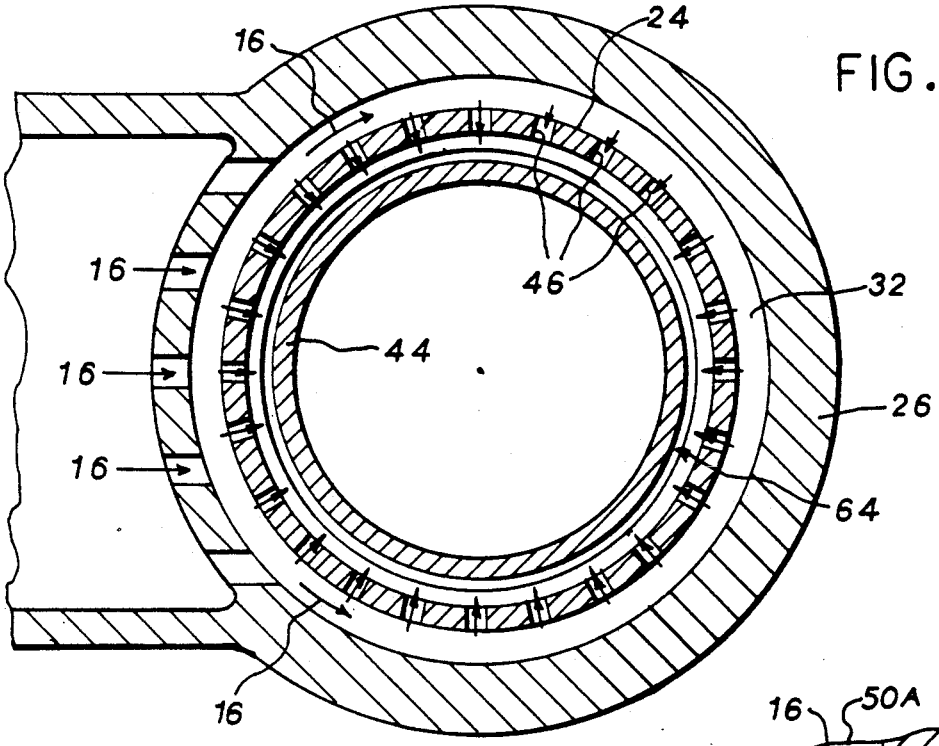
FIG. 5 is a sectional view taken along line 5—5 in FIG. 3.

As stated above but now referring to FIG. 5, water flows into the pressure equalization chamber 32 and then flows through the holes 46 in the diverter/restricter ring 24. The diverter/restricter ring 24 serves to equalize the pressure of the water before it flows into the annular channel 50. If a diverter/restricter ring 24 or some other means for equalizing water pressure around the annular channel opening 48 of channel 50 is not used, a surplus of water will tend to flow from the front end 64 of the spout 10 (i.e. the end away from neck 18). The resulting flow from the spout 10 would be unaesthetic.

Figure 7:
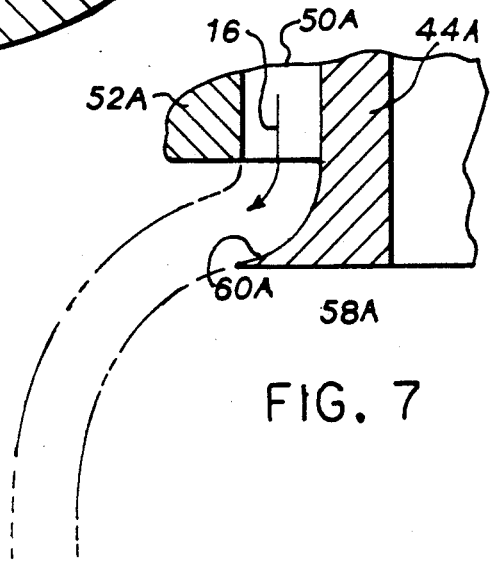
FIG. 7 is a view similar to FIG. 6 showing an alternative embodiment of the invention.

Referring to FIG. 7, an alternative embodiment is shown wherein similar parts are identified by the same number except with an "A" designation. The flared portion 58A at the bottom of wall 44A of the inner annular tube 22 can be concave rather than straight. In FIG. 7, water as indicated at exiting the annular channel 50A is redirected along surface 60A of the flared portion 58A. The concave surface 60A is preferably constructed with a 1/32 inch radius. When the flared portion is concave 58A, the water exiting the spout 10 creates more of a bell shape than a tube.

Referring to both embodiments of FIGS. 6 and 7, the walls 52, 52A and 44, 44A surrounding the annular channels 50, 50A are substantially parallel for the entire length of wall 52, 52A of the outer annular tube 26. The flared portion 58, 58A does not begin to proceed outward until a position at or below the bottom of wall 52, 52A of the outer annular tube 26. These features, 1) substantially parallel walls 52, 52A and 44, 44A, and 2) the the portion 58, 58A of inner wall 44, 44A extending below the outer wall 52, 52A, are critical to create a continuous sheet of water.

If walls 52, 52A are substantially parallel to walls 44, 44A for a sufficient distance, water flowing through the channel 50 between the walls accepts a parallel flow path. When the water accepts a parallel flow path within the channel 50, 50A, the water is likely to retain the proper annular flow path after it is discharged. If the inner wall 44, 44A does not extend below the outer wall 52, 52A, the water is likely to pull together after it discharges. The portion 58, 58A of inner wall 44, 44A that extends below the outer wall 52, 52A restrains the water from pulling together after it discharges. Flaring the portion 58, 58A outward further enhances the ability of the spout 10 to restrain discharge water from pulling together.

It will therefore be appreciated that the present invention provides an apparatus for discharging a continuous sheet of a fluid in such a manner that 1) the sheet of fluid defines a continuous perimeter in a horizontal plane, and 2) sheet integrity is maintained as the fluid flows downward, thus creating a cavity within the sheet. Preferably, the apparatus discharges the continuous sheet in such a manner that the sheet substantially defines the perimeter of a circle in the horizontal plane.

Thus, the invention provides an improved spout. While the preferred embodiments have been described above, it should be readily apparent to those skilled in the art that a number of modifications and changes may be made without departing from the spirit and scope of the invention. For instance, the present invention also contemplates flowing the sheet of the fluid in other geometric configurations which are not the perimeter of a circle in a horizontal plane, such as, but not limited to oval, triangle, or rectangle perimeters. Further, certain advantages can be obtained by using the pressure equalizing means without the feature of the parallel walls and the extension of the inner wall. All such modifications and other modifications within the spirit of the invention are meant to be in the scope of the invention.

I claim:

1. A plumbing spout for discharging a continuous sheet of liquid, wherein the sheet defines a closed perimeter in a horizontal plane and a cavity within the sheet, the spout comprising:

a spout body having an inner wall that encloses upon itself to surround an inner core, and an outer wall that surrounds the inner wall with a chamber defined therebetween;

a divider that divides the chamber into a pressure modification channel that extends substantially around the core and that assists in evening out circumferential differentials in liquid pressure around the core, and an outlet chamber that extends substantially around the core;

means for permitting liquid to pass from the pressure modification channel to the outlet chamber;

a radially peripherally extending inlet for carrying liquid from a source to the pressure modification channel;

an outlet extending circumferentially substantially around the core and extending from the outlet chamber, the outlet being formed by inner wall and outer wall surfaces that extend a sufficient distance parallel to each other such that the liquid can adopt a flow path substantially parallel to the wall surfaces when it passes between the surfaces, the outlet being further formed by an inner wall surface extending beyond an outer wall surface at an outlet terminus;

whereby liquid can enter the pressure modification channel in a circumferentially unbalanced pressure manner, and exit the outlet terminus in a substantially circumferentially pressure equalized form.

2. The spout of claim 1, wherein an inner wall surface also flares radially outward at the outlet terminus.

3. The spout of claim 2, wherein the core is hollow.

* * * * *